United States Patent [19]

Saxman

[11] 4,258,805

[45] Mar. 31, 1981

[54] LOW CUTTER LOAD RAISE HEAD

[75] Inventor: William C. Saxman, Irving, Tex.

[73] Assignee: Dresser Industries, Inc., Dallas, Tex.

[21] Appl. No.: 69,964

[22] Filed: Aug. 27, 1979

[51] Int. Cl.[3] ..... E21B 10/28

[52] U.S. Cl. ..... 175/344; 175/53

[58] Field of Search ..... 175/53, 332–335, 175/344, 351, 386–388, 406, 407, 392

[56] References Cited

U.S. PATENT DOCUMENTS

| | | | |
|---|---|---|---|
| 1,745,567 | 2/1930 | Cross et al. | 175/333 X |
| 1,841,302 | 1/1932 | Simmons | 175/406 X |
| 2,837,324 | 6/1958 | Aschacker | 175/406 X |
| 2,868,510 | 1/1959 | Dean | 175/344 X |
| 3,379,264 | 4/1968 | Cox | 175/334 X |
| 3,633,691 | 1/1972 | Talbert | 175/334 |
| 3,750,767 | 8/1973 | Pessier | 175/53 |
| 3,995,706 | 12/1976 | White | 175/392 |

*Primary Examiner*—James A. Leppink
*Assistant Examiner*—Richard E. Favreau
*Attorney, Agent, or Firm*—Eddie E. Scott; Fred A. Winans

[57] ABSTRACT

A raise head having a multiplicity of cutters for enlarging a pilot hole into a larger diameter hole by disintegrating the earth formations that surround the pilot hole is provided that will require lower cutter loads to penetrate the formations being bored by directing the rock fracture planes toward the pilot hole forcing the rock to yield with less input energy. The cutters are positioned on the raise head to provide an earth formation contact profile with a major portion of said earth formation contact profile extending outward and upward from said pilot hole. The included angle between the major portion of the earth formation contact profile and the axis of the pilot hole is less than 90°.

3 Claims, 1 Drawing Figure

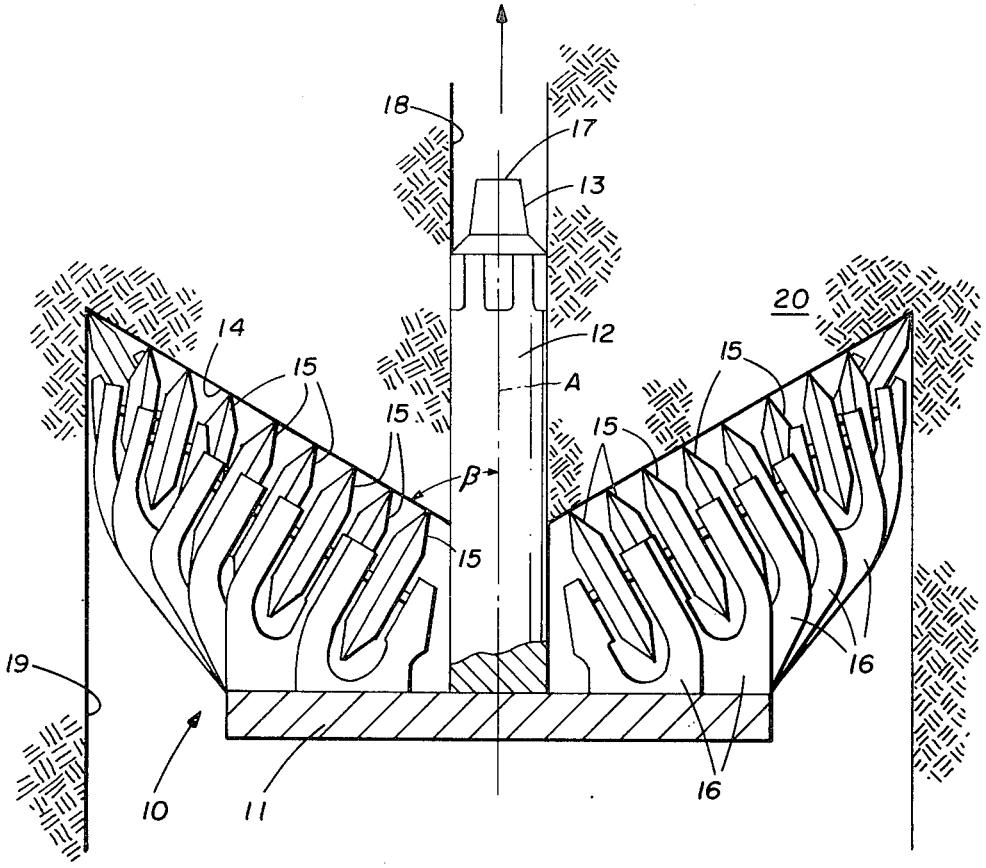
18
17
13
20
14
15
12
A
15
15
15
β
15
19
16
10
11
16

LOW CUTTER LOAD RAISE HEAD

BACKGROUND OF THE INVENTION

The invention relates to the art of earth boring and, more particularly, to a raise boring head for boring raise holes in a mine by enlarging a pilot hole into a raise hole having a larger diameter than the pilot hole.

A relatively large diameter hole may be provided between a first location and a second location in a mine or other underground works by an operation commonly referred to as raise drilling. A raise drilling operation begins by drilling a small diameter pilot hole through the earth from a first location to an opening at the second location using a small diameter pilot bit. After the pilot hole is completed, the pilot bit is removed from the drill string and a large diameter raise bit or raise head attached. The raise head is rotated and drawn along the pilot hole, thereby enlarging the pilot hole to the desired size.

DESCRIPTION OF PRIOR ART

United States Department of the Interior, Bureau of Mines, Technical Report on Foster-Miller Associates, Inc., Contract H0210044, "Design, Fabricate and Test a Conical Borer" described a conical borer system.

In U.S. Pat. No. 3,633,691 to Milton L. Talbert, patented Jan. 11, 1972, a bit for drilling large diameter holes is shown. Cutters are arranged in a staged configuration around the central shaft. The innermost cutters are the same large cutters used at other locations on the bit allowing complete interchangeability. The innermost cutters are turned inward. This reduces the uncut bottom next to the pilot hole and provides a stronger bit because the central shaft has not been weakened by milling or other operations.

In U.S. Pat. No. 3,638,740 to Dan B. Justman, patented Feb. 1, 1972, a rotary drill for producing a raise bore including a body having roller cutter assemblies arranged to cut the working face of an earth formation so that the plane of an inner portion of the working face inclines downwardly and inwardly towards a pilot hole, and the plane of an outer portion of the working face inclines downwardly and outwardly towards the gage of the raise bore, and the plane of an intermediate portion of the working face extends between the inner and outer inclined portions is shown.

In U.S. Pat. No. 3,750,767 to Rudolf Carl Otto Peisser, patented Aug. 7, 1973, a reaming type rock boring drill having an innermost cutter, rotatably supported as a beam is shown. A sleeve or other support member disposed close to, but spaced apart from, the drill stem that forms a portion of the bit body serves as a trunnion or journal for the inner end of the load pin of the cutter bearing assembly. Drilling with such an assembly results in an uncontacted kerf of rock contiguous with the pilot hole. This kerf is disintegrated by mounting the innermost cutter so that the forces applied to the borehole bottom by this cutter act along a line directed into the formation and inwardly toward the pilot hole. As a result, a much higher cutting efficiency is achieved, when contrasted with earlier dispositions in which the innermost cutter acted directly on the bottom of the borehole immediately on the bottom of the borehole immediately adjacent the pilot hole.

In U.S. Pat. No. 3,805,901 to William D. Coski, patented Apr. 23, 1974, an earth cutter assembly is shown. The assembly comprises a rotatable body for supporting rollertype earth cutters, and means for mounting the earth cutters to the body, in which the cutters are so configured and mounted as to cooperate, upon rotation of the body, to define at least one, overall circular and convex cutting surface of the assembly.

SUMMARY OF THE INVENTION

The present invention provides a raise head for enlarging a pilot hole into a large diameter hole by disintegrating the earth formations that surround the pilot hole. The raise head includes a cutterhead with a multiplicity of rolling cutters for contacting and disintegrating the formations that surround the pilot hole. The cutterhead comprises a series of rolling cutters mounted so that the cutter face or contact profile forms an inverted conical shape. The cutters are positioned on the raise head to provide contact profile with a major portion of said earth formation profile extending radially outward and axially upward along said pilot hole. The angle between the major portion of the contact profile and the pilot hole is less than 90°.The raise head will require lower cutter loads to penetrate the formations being bored by directing the rock fracture planes toward the pilot hole, forcing the rock to yield with less input energy. The overall height of the raise head is reduced providing greater accessiblity of the raise head to underground job sites. The above and other features and advantages of the present invention will become apparent from a consideration of the following detailed description of the invention when taken in conjunction with the accompanying drawings.

Brief Description of the Drawings

The single FIGURE of drawings is a front view partially in section of a raise bit constructed in accordance with the present invention.

DETAILED DESCRIPTION OF THE INVENTION

Referring now to the drawings, a raise bit constructed in accordance with the present invention is illustrated. The bit is generally designated by the reference number 10. A main plate 11 forms the basic framework of the bit 10. A central drive stem 12 projects from the main plate 11. A central passage 17 in drive stem 12 allows drilling fluid (air) to be circulated through the bit 10. The upper portion 13 of the drive stem 12 is threaded to allow the bit 10 to be easily connected to, and disconnected from, a rotary drill string (not shown). A multiplicity of saddles 16 are mounted on the main plate 11 containing a corresponding multiplicity of rolling cutters 15. The rolling cutters 15 contact and disintegrate the formations surrounding the pilot hole above the plate 11 during the raise drilling operation.

The raise head 10 is utilized for enlarging a pilot hole 18 into a larger diameter hole 19 by disintegrating the earth formations 20 surrounding the pilot hole 18. The drive stem 12 has an upper end 13 for projecting into the pilot hole. The multiplicity of rolling cutters 15 that are positioned in the saddles 16 contact and disintegrate the earth formations 20 surrounding the pilot hole 18. The cutters 15 are positioned to provide an earth formation contact profile 14 (i.e. a line joining the uppermost contact of each successive radially outer cutter, having an effective major portion that extends radially outward from said pilot hole and axially upward toward said upper end 13 of the drive stem 12 with the angle B between the axis A of said pilote hole 12 and said major portion of said earth formation contact profile 14 being substantially less than 90°.In the preferred embodiment shown in the drawings, the profile is a straight line and the angle B is 70°.

The present invention provides a cutterhead that will require lower cutter loads to penetrate the formations being bored by directing the rock fracture planes toward the pilot hole. This forces the rock to yield with less input energy. The cutterhead enhances the capability of the drive machine by reducing the required unit loading to fracture the formation. Another advantage is the reduction in the overall height of the raise head, which is often a factor in the accessibility to underground job sites.

Prior art cutterheads work on the principle of mounting rolling cutters on a cutterhead wherein a majority of the bottom hole profile is either perpendicular, with respect to the drill string, or is diverging away from the drill string and pilot hole at an angle greater than 90°.This style of cutterhead requires high unit loading to fracture the rock formation. This is because the forces are being directed into virtually infinite limits. The cutterhead of the present invention works on the principle of mounting rolling cutters on a cutterhead to destroy the formation being bored. A majority of the bottom hole profile 14 is diverging upward away from the drill string and pilot hole at an angle less than 90°.Due to the acute angle formed between the axis A of the pilot hole and the bottom hole profile 14, unit loading becomes more efficient. This is because the loading on the formations is directed toward a free face.

The embodiments of the invention in which an exclusive property or privilege is claimed and defined as follows:

1. A raise bit for enlarging a pre-drilled pilot hole into a larger diameter hole for disintegrating the earth formations surrounding the pilot hole, comprising:

a central drive stem for projecting into the pilot hole and guiding the bit;

a cutterhead attached to the lower end of the stem and projecting generally transverse to the axis of rotation of the stem and supporting thereon a plurality of rolling cutters, each having an annular earth engaging surface for contacting and disintegrating the earth through rolling contact between said surface and said earth above said cutterhead, said plurality of rollers defining an earth contacting profile which extends upwardly outwardly from said pilot hole over substantially the radius of the larger diameter hole formed by said bit and whereby any line connecting any two points of said earth contacting profile intersects the axis of said stem at an included angle substantially less than 90°.

2. Structure according to claim 1 wherein said earth contacting profile is substantially a straight line throughout the radius of said larger diameter hole.

3. Structure according to claim 2 wherein said included angle is on the order of 70°or less.

* * * * *